United States Patent [19]

Smith

[11] Patent Number: 5,024,434

[45] Date of Patent: Jun. 18, 1991

[54] MULTIFLEX EXERCISE DEVICE

[76] Inventor: Mark R. Smith, 502 Stanely Ave., Clarksburg, W. Va. 26301

[21] Appl. No.: 499,797

[22] Filed: Mar. 27, 1990

[51] Int. Cl.[5] ..... A63B 21/072

[52] U.S. Cl. ..... 272/123

[58] Field of Search ..... 272/67, 93, 116, 117, 272/122, 123, 143, DIG. 4

[56] References Cited

U.S. PATENT DOCUMENTS

| | | | |
|---|---|---|---|
| 1,333,005 | 3/1920 | Warner . | |
| 1,645,457 | 10/1927 | Schall | 272/123 |
| 1,779,594 | 10/1930 | Hall | 272/123 |
| 2,819,081 | 1/1958 | Touraine | 272/67 |
| 3,384,370 | 5/1968 | Bailey et al. . | |
| 4,461,473 | 7/1984 | Cole | 272/123 |
| 4,618,143 | 10/1986 | Twardosz | 272/123 |
| 4,629,184 | 12/1986 | Selkee | 272/123 |
| 4,690,400 | 9/1987 | Metz | 272/123 |

FOREIGN PATENT DOCUMENTS

| | | | |
|---|---|---|---|
| 223926 | 6/1985 | German Democratic Rep. | 272/123 |
| 685710 | 1/1953 | United Kingdom | 272/123 |
| 2186500 | 8/1987 | United Kingdom . | |

OTHER PUBLICATIONS

Copies of pp. 1 and 2 of the Office Action of Feb. 7, 1986, in the File of Pat. No. 4,618,143.

*Primary Examiner*—Robert Bahr

*Attorney, Agent, or Firm*—Webb, Burden, Ziesenheim & Webb

[57] ABSTRACT

Disclosed is a weight lifting apparatus which includes an elongated bar having a pair of spaced, open circular housings mounted thereto. Each of the circular housings has a support member extending inwardly along at least a portion of an inner circumference of the housing. A handle assembly is positioned within each of the circular housings and is rotatably mounted on the support member. Each handle assembly includes a pair of rotating handle members positioned on opposite sides of the support member and fastened together in sliding engagement with the support member.

21 Claims, 6 Drawing Sheets

MULTIFLEX EXERCISE DEVICE

BACKGROUND OF THE INVENTION

1. Field of the Invention

This invention relates generally to exercise equipment and, more particularly, to barbells having a pair of rotatable handles.

2. Description of the Prior Art

The use of an elongated barbell carrying one or more weight plates at each end is well known in the exercise field. The weight plates are held in place on the bar by a removable collar or other locking device. With one straight bar and a plurality of weight plates in a number of sizes, various muscles of the body can be readily exercised and developed.

In exercising certain muscles of the body, the hand position dictated by a straight bar is not ideal and other specialized bars have been developed. For example, a common triceps bar has a pair of spaced handles which are oriented transverse to the elongated bar carrying the weights. With the triceps bar, the hands are positioned in an opposed parallel relationship when the bar is gripped. A common curl bar, for exercising the biceps, has a pair of zig-zag-shaped handles which are oriented at opposed 45 degree angles to the bar carrying the weights. When the curl bar is held, a user's hand will be twisted symmetrically about the bar's center point. While the specially designed bars will comfortably and efficiently exercise the targeted muscle, a user must purchase several different bars and move the weight plates from one bar to another during a workout. Moreover, these bars all provide for a rigid positioning of the hands which remains fixed throughout a particular exercise.

A number of devices have been developed which overcome the problems with a straight bar and permit various muscles of the body to be efficiently exercised with a single bar. The devices shown in U.S. Pat. Nos. 3,384,370; 4,461,473; 4,629,184; 4,690,400 and United Kingdom patent application Ser. No. 2,186,500 show various arrangements of elongated bars which include a pair of rotatable handles which can be moved to a desired location. U.S. Pat. No. 1,333,005 shows a single rotatable handle connected to a weight. These devices also permit relative motion of the hands with respect to each other during the exercise. For example, in a supination motion during a bicep curling exercise, the hands are rotated from an initial position with the palms facing down or facing each other to a final position with the palms facing upward toward the user's chest. The reverse motion is referred to as pronation. Supination and pronation further increases muscle development during the exercise. Several of the prior art devices also provide for the application of additional force or resistance during the supination and pronation motions.

While providing for the relative hand motion desired during certain exercises, and the ability to move the handles to different positions in a single bar, most of the prior art devices are unnecessarily complicated in their construction, particularly when mechanisms for providing force or resistance during motion are induced. Moreover, even in the devices which provide for free rotational movement of the handles (such as in U.S. Pat. Nos. 3,384,370 and 4,690,400) the construction is far too complicated to manufacture inexpensively or is prone to breakage. This breakage problem is particularly acute when the exercise bar is used in conjunction with heavy weights.

Therefore, it is an object of the present invention to provide a weight lifting apparatus which includes a pair of rotatable handles, but which is uncomplicated in construction, which is relatively inexpensive to manufacture, and which is durable even when used with heavy weights

SUMMARY OF THE INVENTION

Accordingly, I have invented a weight lifting apparatus which includes an elongated bar having a pair of spaced, open circular housing mounted thereto. Each of the circular housings has a support member extending inwardly along at least a portion of an inner circumference of the housing. A handle assembly is positioned within each of the circular housings and is rotatably mounted on the support member. Each handle assembly includes a pair of rotating handle members positioned on opposite sides of the support member and fastened together and sliding engagement with the support member.

In a preferred embodiment, each of the rotating handle members includes a circular ring and a grip extending across and connected to the ring. The grips on the rotating handle members are aligned with each other when the pair of rotating handle members are positioned within the circular housings. Each grip includes a projecting tongue at each end which engages a corresponding groove in the ring.

The support member on the inner circumference of the housing is preferably a flange which extends substantially along the inner circumference of the circular housing and the circular ring on each rotating handle member includes an offset extending around its outer circumference. The offsets on the rotating handle members together form a track which surrounds and contacts the flange when the pair of rotating handle members are fastened together within the circular housings. The flange preferably has a rectangular cross-sectional shape and the offsets would have a corresponding right-angle shape. It is also contemplated that the offset on one of the rotating handle members would be wider than the offset on the other rotating handle member, such that the circular rings overlap each other when fastened together within the circular housing.

The flange may also includes a plurality of recesses. At least one of the rotating members would include in the offset at least one outwardly biased locking pin, preferably two, which is adapted to engage the recesses and lock the handle assembly in a desired position within the circular housing. The apparatus may also include a plurality of locking grooves near each end of the elongated bar. A locking collar is carried by each end of the elongated bar, with the locking collar having at least two pivoting locking levers which are biased inwardly to normally engage the locking grooves. The locking collars may have a pair of spaced channels extending therethrough to an axial bore therein and a locking lever is pivotally mounted in each channel. The locking levers may each terminate at an inner end in a notch to engage a locking groove, and may terminate at an outer end in a flat thumb pad. The inward bias on the locking levers may be provided by a spring extending from the locking collar to a rear surface of each thumb pad.

DETAILED DESCRIPTION OF THE PREFERRED EMBODIMENTS

Figure 1:
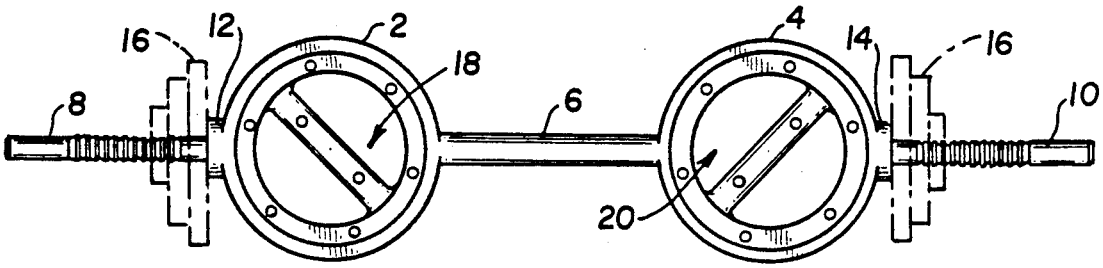
FIG. 1 is a front elevational view of a first embodiment of a weight lifting apparatus in accordance with the present invention.

A first embodiment of a multiflex weight lifting exercise apparatus in accordance with my invention is shown in FIGS. 1–10. Referring initially to FIG. 1, the apparatus includes an elongated bar having mounted thereto a first open circular housing 2 and a second open circular housing 4 spaced therefrom. The elongated bar includes a middle bar 6 extending between the first circular housing 2 and the second circular housing 4, a first end bar 8 connected at one end to and extending from the first circular housing 2 opposite the middle bar 6, and a second end bar 10 connected at one end to and extending from the second circular housing 4 opposite the middle bar 6. The middle bar 6, first end bar 8 and second end bar 10 are oriented along a straight line so that the weight lifting apparatus resembles a straight bar interposed with a pair of spaced, open circular housings 2, 4.

The apparatus may also include a wider first shoulder 12 where the first end bar 8 is attached to the first circular housing 2. Similarly, a wider second shoulder 14 is provided where the second end bar 10 is attached to the second circular housing 4. The shoulders 12, 14 provide a wider contact area for weight plates 16 positioned on the first end bar 8 and second end bar 10 and keep the plates 16 from wobbling in place.

A first handle assembly 18 is positioned within the first circular housing 2 and is rotatably mounted on a support member therein. Similarly, a second handle assembly 20 is positioned within the second circular housing 4 and is rotatably mounted on a support member therein. The construction and operation of the handle assemblies 18, 20 in the circular housings 2, 4, will be described hereinafter in more detail.

Figure 2:
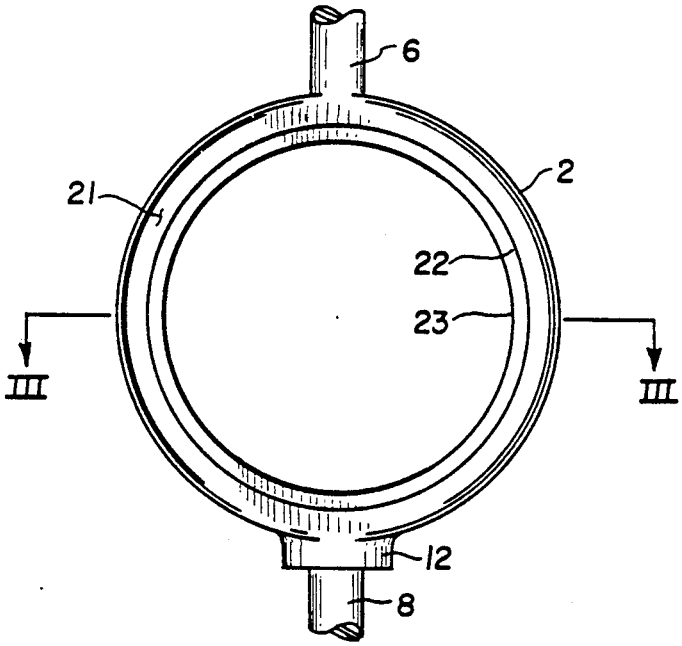
FIG. 2 is a front elevational view of the circular housing included in the weight lifting apparatus shown in FIG. 1.
Figure 3:
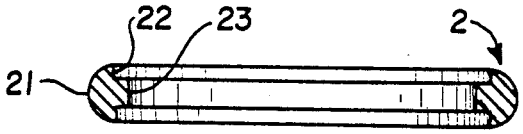
FIG. 3 is a section taken along lines III—III in FIG. 2.
Figure 4:
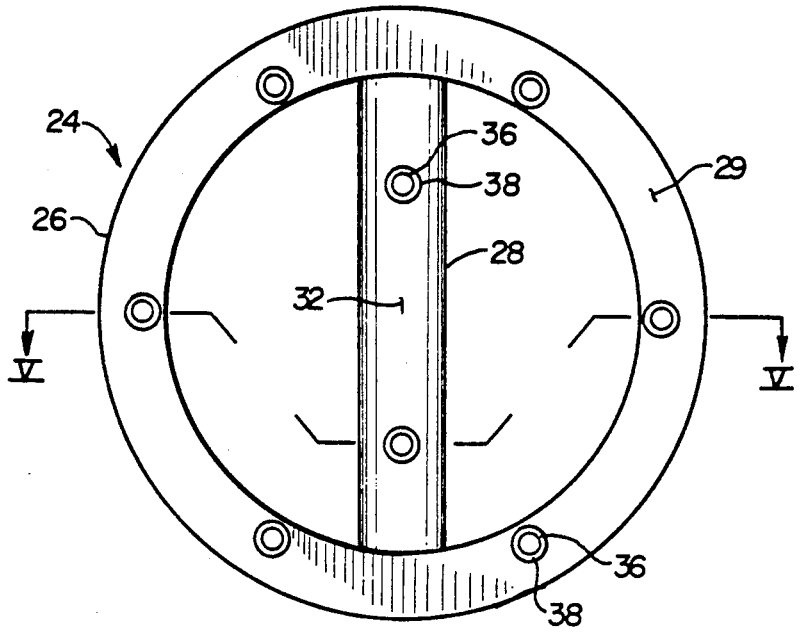
FIG. 4 is a front elevational view of a first rotating handle member included in the weight lifting apparatus shown in FIG. 1.
Figure 5:
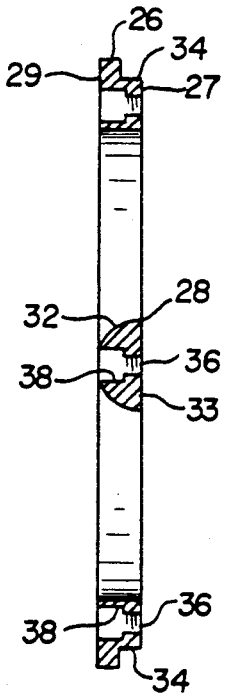
FIG. 5 is a section taken along lines V—V in FIG. 4.
Figure 6:
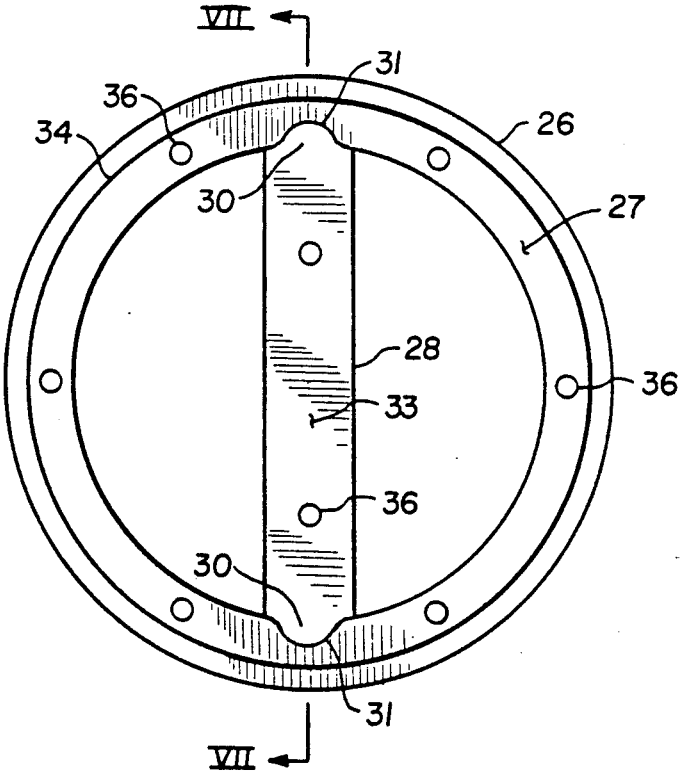
FIG. 6 is a rear elevational view of the rotating handle member shown in FIG. 4.
Figure 7:
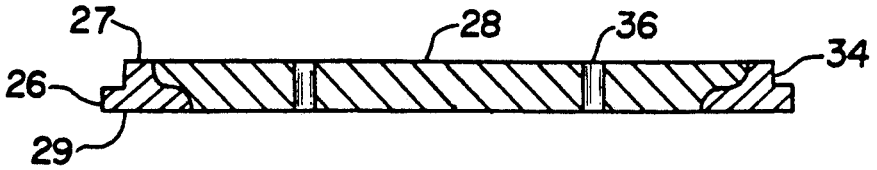
FIG. 7 is a section taken along lines VII—VII in FIG. 6.
Figure 8:
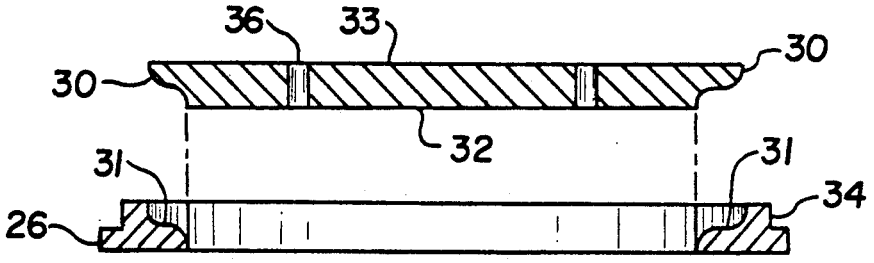
FIG. 8 is an exploded view of the section taken along lines VII—VII in FIG. 6.

Referring now to FIGS. 2 and 3, there is shown the details of the construction of the first circular housing 2 with the first handle assembly 18 removed. The first circular housing 2 is essentially a circular ring having a half circular cross-sectional shape with a flat outer surface 21 and a flat inner surface 22. The inner surface 22 defines an inner circumference of the first circular housing 2. A support member extends inwardly toward the open area of the first circular housing 2 along at least a portion of its inner surface 22. The support member is preferably a flange 23 on the center of the inner surface 22 extending continuously along the entire inner circumference of the first circular housing 2. Although the flange 23 is shown having a rectangular cross-sectional shape, other shapes could also be used for the flange 23. The second circular housing 4 is identical to the first circular housing 2.

The handle assemblies 18, 20 rotatably mounted on the flange 23 in each circular housing 2, 4 include a pair of rotating handle members which are positioned on opposite sides of the flange 23 and removeably fastened together in sliding engagement therewith. FIGS. 4–8 show the details of the construction of one of the rotating handle members, referred to as a first rotating handle member 24. This first handle member 24 includes a circular ring 26 having a grip 28 extending across the open area defined by the ring 26 and connected thereto. The grip 28 includes at each end a projecting tongue 30 which engages a corresponding groove 31 in the ring 26. The grooves 31 extend downwardly into the ring 26 from its inner surface 27 thereof. The corresponding grip 28 is positioned within the ring 26 from its inner surface 27. The grip 28 preferably has a half circular cross-sectional shape with a curved outer surface 32 oriented toward the outer surface 29 of the ring 26 and a flat inner surface 33 oriented toward the inner surface 27 of the ring 26.

The ring 26 has a rectangular cross-sectional shape and includes an offset 34 extending around its outer circumference adjacent its inner surface 27. As shown in the figures, this offset is a right angle offset which corresponds in size to about one-half of the flange 23 on the first circular housing 2. The first handle member 24 includes a plurality of bolt holes 36 drilled through both the ring 26 and the grip 28. The bolt holes 36 terminate in wider flared areas 38 at the outer surface 29 of the ring 26 and the outer surface 32 of the grip 28.

Figure 9:
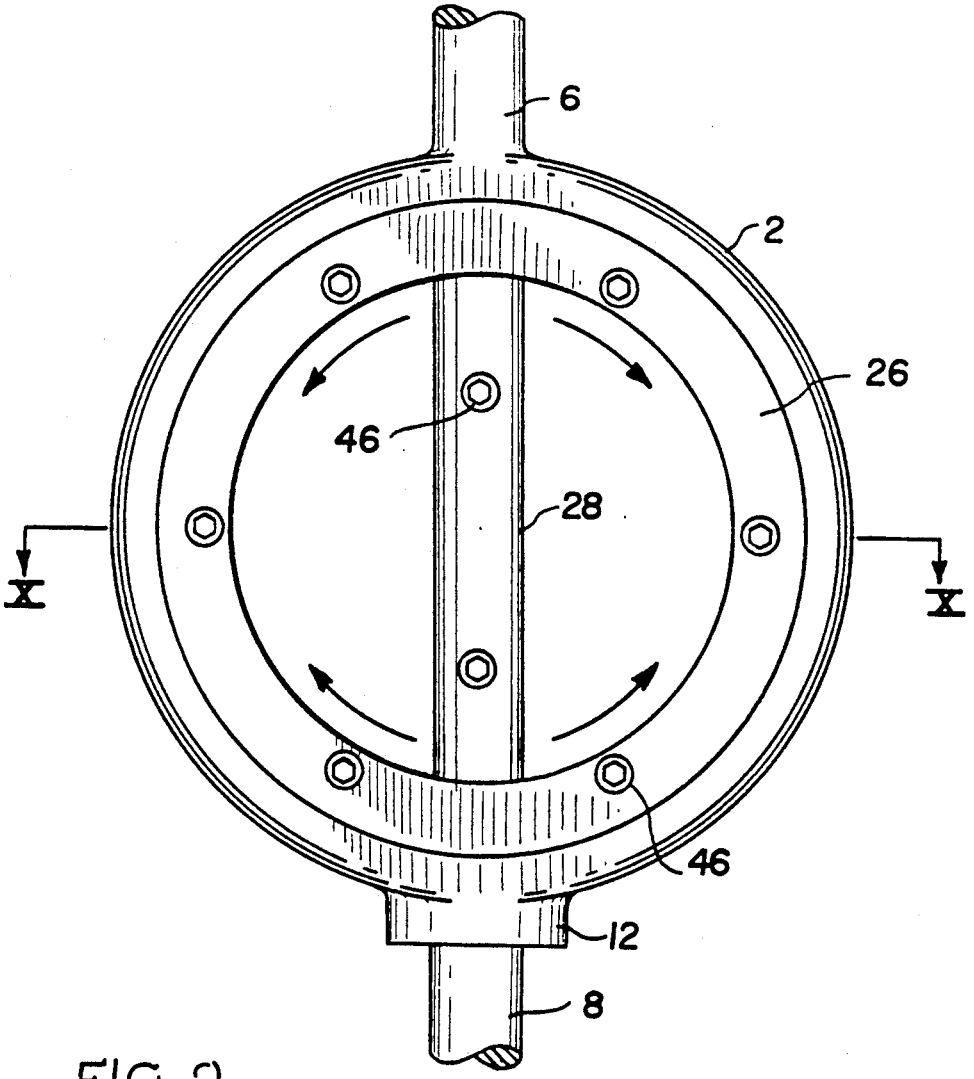
FIG. 9 is a front elevational view of the circular housing shown in FIG. 2 with a handle means mounted thereto.
Figure 10:
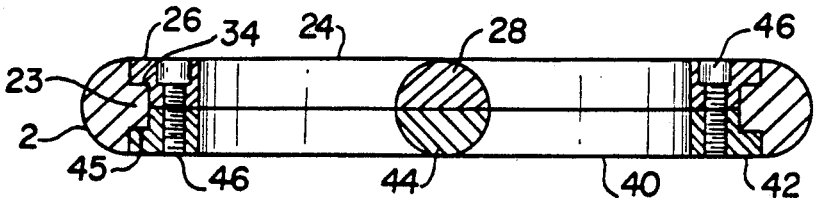
FIG. 10 is a section taken along lines X—X in FIG. 9.

The manner of fastening the first rotating handle member 24, as well as a second rotating handle member 40, together to form the first handle assembly 18 within the first circular housing 2 is shown in FIGS. 9 and 10. The second handle member 40 is nearly identical to the first handle member 24 and includes a circular ring 42 and a grip 44. The only difference between the first handle member 24 and the second handle member 40 is that no flared areas are provided where the bolt holes terminate at the outer surface thereof. The first handle member 24 is positioned within the opening of the first circular housing 2 with its offset 34 in contact with the flange 23 and with the rest of the outer circumference of circular ring 26 in contact with the flat inner surface 22 of the first circular housing 2. Similarly, the second handle member 40 is positioned within the opening of the first circular housing 2 with its offset 45 in contact with the flange 23 and with the rest of the outer circumference of circular ring 42 in contact with the flat inner surface 22 of the first circular housing 2. In addition, the second handle 40 is oriented such that its grip 44 is aligned with the grip 28 on the first handle member 24. The handle members 24 and 40 are joined securely together by passing bolts 46 through the holes 36 in the first handle member 24 and into similar and aligned holes in the second handle member 40. The flared areas 38 in the first handle member 24 accommodate the wider heads of the bolts 46 so that the bolts 46 are flush with the outer surfaces.

The inner surfaces of the handle members 24, 40 abut against and contact one another along the aligned circular rings 26, 42 and grips 28, 44. In addition, offsets 34 and 45 together form a track which surrounds and contacts the flange 23. The track both holds the handle assembly 18 within the first circular housing 2, and also provides a surface for the handle assembly 18 to ride along the flat inner surface 22 of the first circular housing 2. By aligning the flat inner surfaces of the grips 28, 44 together, a composite structure having a smooth, circular outer shape is provided. This enables a user to comfortably and readily grasp the handle assembly 18 within the first circular housing 2. Moreover, the grips 28, 44 are securely held in place by the tongue and groove arrangement described above.

The rotational movement of the first handle assembly 18 abut the center of the first circular housing 2 is shown clearly in FIG. 9. The second handle assembly 20, which is mounted to and within the second circular housing 4, is identical to the first handle assembly 18.

It can be appreciated that other configurations for the flange and offsets can be provided as long as they provide for mounting the handle assemblies within the circular housings and for free rotational movement therein. For example, the flange could have a half circular cross-section and each offset could have a corresponding curved surface. It is anticipated that the circular housings, the elongated bar and handle assemblies will be formed of metal. While the metal-to-metal contact between the flange and the track formed by the offsets will work satisfactorily, it is also contemplated that Teflon® or another lubricant can be provided on the flange and/or offsets to provide for free rotational movement therebetween. It is also preferred that the outer surfaces of the rotating handle members be aligned with the circular housing and not extend therebeyond. This provides for a smoother appearance and eliminates the possibility of fingers or clothing being caught within the handle assemblies while they are being rotated.

Figure 11:
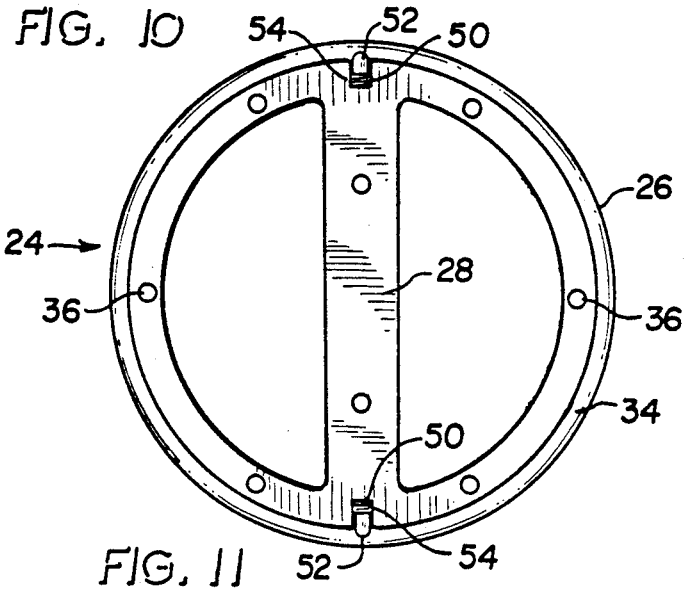
FIG. 11 is a rear elevational view of a second embodiment of a rotating handle member in accordance with the present invention.
Figure 12:
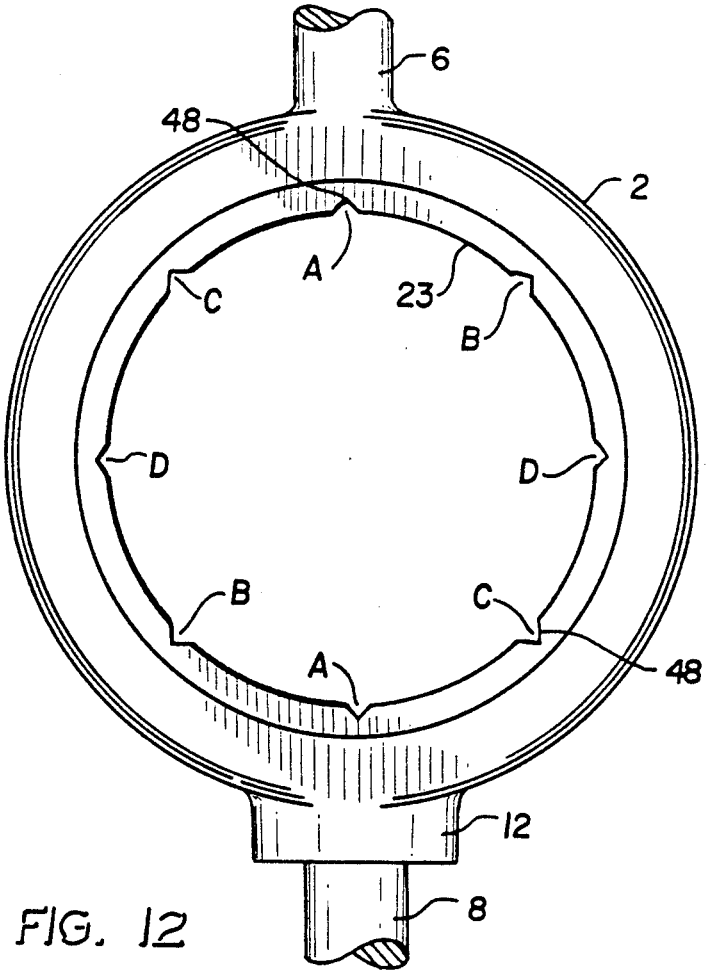
FIG. 12 is a front elevational view of a circular housing used with the second embodiment of the rotating handle member shown in FIG. 11.

While the embodiment discussed above in connection with FIGS. 1–10 provides for free rotational movement of the handle assemblies 18, 20 within the circular housings 2, 4, it may be desired to lock the handle assemblies at a particular position. An arrangement for providing a releasable locking mechanism is shown in FIGS. 11 and 12. In accordance with this embodiment, the flange 23 on the first circular housing 2 includes a plurality of recesses 48 therein. The recesses are shown having a V-shaped configuration, although other configurations could also be used. The recesses are spaced approximately 45° from each other, with a pair of recesses 48 aligned along the direction of the elongated bar.

A modified first rotating handle member 24 in accordance with this embodiment includes a pair of blind holes 50 extending into the ring 26 from the offset 34 in the area near the ends of the grip 28. FIG. 11 also shows an arrangement in which the grip 28 is integrally formed with the ring 26 rather than being a separate member. A locking pin 52 is positioned within each blind hole 50 and is biased outwardly by a spring 54 extending from the locking pin 52 to the bottom of the blind hole 50. Similar locking pins can be provided on an associated second rotating handle member if desired, although it is not required. The locking pins 52 are provided approximately 180° opposite each other so that they can be aligned with and contact a pair of recesses 48 in the flange 23 when the handle members are mounted within the circular housing.

The springs 54 will urge the locking pins 52 outwardly and into engagement with an aligned recess 48. This force will act to hold the handle assembly 18 in a particular position as dictated by the recesses 48. For example, if the exercise apparatus is to be used as a standard, elongated bar, then the handle assembly will be moved such that the locking pins 52 engage the recesses 48 in alignment with the elongated bar. These recesses are labeled as reference element A in FIG. 12. When it is desired to move the handle assembly to a different position, the handle assembly is rotated within the circular housing until a force is developed which causes each locking pin 52 to ride up the side of a recess 48 and compress the spring 54 within the blind hole 50. The handle assembly is then moved until the locking pins 52 engage another pair of recesses 48 at a desired location. For example, if the exercise apparatus is to be used as a curl bar, then the handle assemblies will be moved such that the locking pins 52 engage either recesses B or recesses C as shown in FIG. 12. Similarly, if the exercise apparatus is to be used as a tricep bar, then the handle assemblies will be moved such that the locking pins 52 engage recesses D and the grips are oriented perpendicular to the elongated bar.

Figure 13:
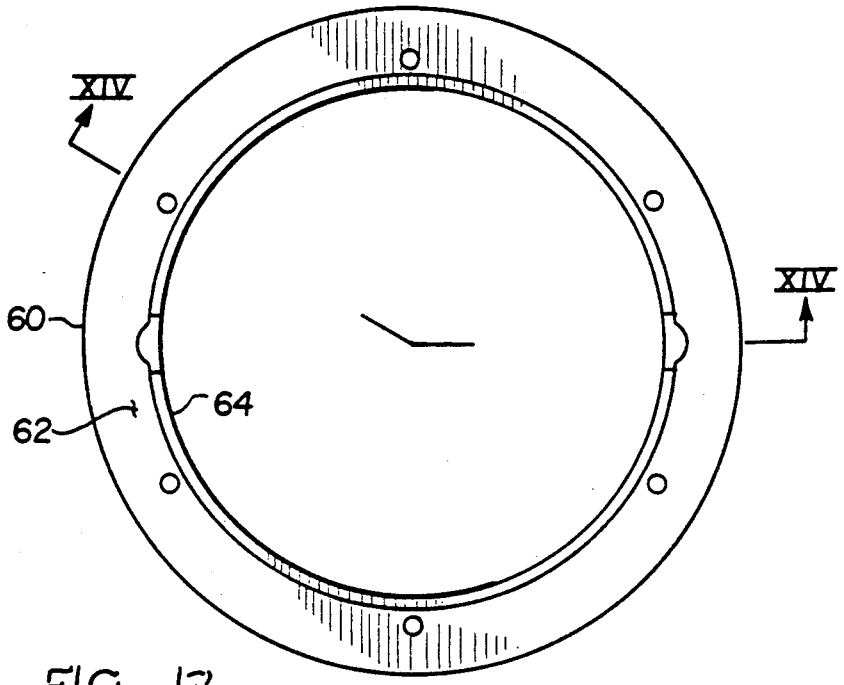
FIG. 13 is a rear elevational view of a third embodiment of a first rotating handle member in accordance with the present invention.
Figure 14:
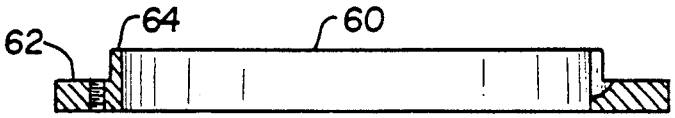
FIG. 14 is a section taken along lines XIV—XIV in FIG. 13.
Figure 15:
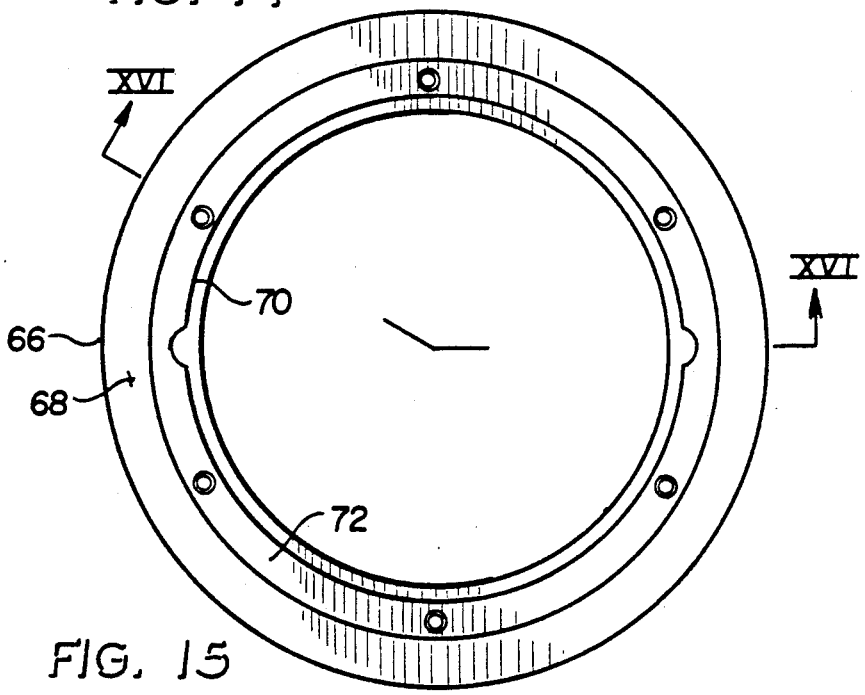
FIG. 15 is a rear elevational view of a second rotating handle member used with the first rotating handle member shown in FIG. 13.
Figure 16:
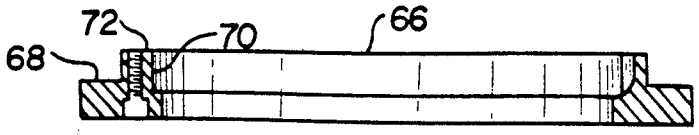
FIG. 16 is a section taken along lines XVI—XVI in FIG. 15.
Figure 17:
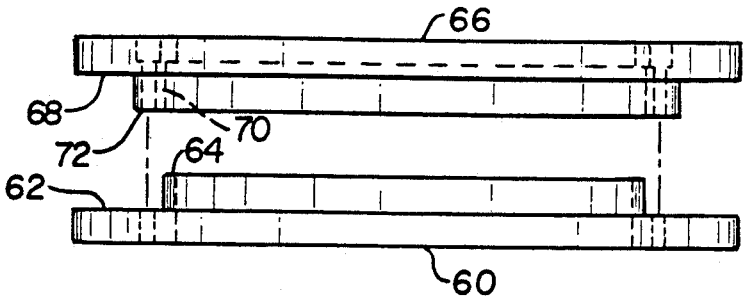
FIG. 17 is an exploded side elevational view of the rotating handle members shown in FIGS. 13 and 15 joined together.
Figure 18:
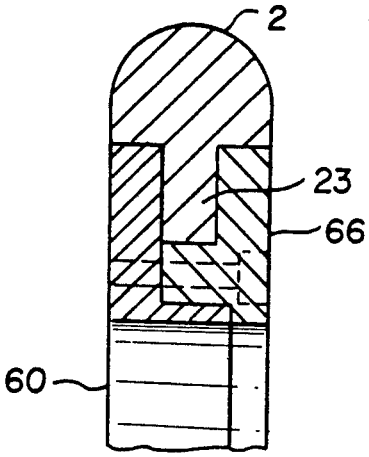
FIG. 18 is a sectional view of a portion of the circular housing showing the rotating handle members of FIGS. 13 and 15 mounted thereto.

Modifications to the rings included in the rotating handle members are shown in connection with FIGS. 13–18. For the sake of clarity, the grips are not shown connected to these rings. Referring now to FIGS. 13 and 14, a first circular ring 60 is shown. This ring 60 is similar in configuration to rings 26 and 42 discussed above, however, the offset 62 which extends about the outer circumference of this first ring 60 is significantly wider than the flange 23. As a result, an inwardly directed lip 64 is formed between the offset 62 and the inner circumference of the first ring 60. The second ring 66 in accordance with this embodiment is shown in FIGS. 15 and 16. This second ring 66 includes an outer offset 68 extending around its outer circumference which is as wide as the flange 23 on the circular housing. However, this outer offset 68 is as deep as the flange 23, and is thus twice as deep as the offsets 34, 45 discussed above. Further, the second ring 66 includes an inner offset 70 which extends around its inner circumference. An inwardly directed lip 72 is formed between the outer offset 68 and inner offset 70 of second ring 66.

The offset 62 on the first ring 60 and the outer and inner offsets 68, 70 on the second ring are dimensioned such that the circular rings 60 and 66 overlap each other when fastened together within the first circular housing 2. This is shown more clearly in FIGS. 17 and 18. The outer offset 68 of the second ring 66 contacts two of the three sides of the flange 23. The third side of the flange 23 is contacted by a portion of the offset 62 in the first ring 60. The lip 64 in the first ring 60 engages the inner offset 70 on the second ring 66. Thus, the lip 72 in the second ring 66 is sandwiched between the flange 23 on the first circular housing 2 and the lip 64 on the first ring 60. This arrangement provides for a more snug and secure attachment between the first ring 60 and second ring 66 when they are mounted within the circular housing 2 and onto the flange 23.

Figure 19:
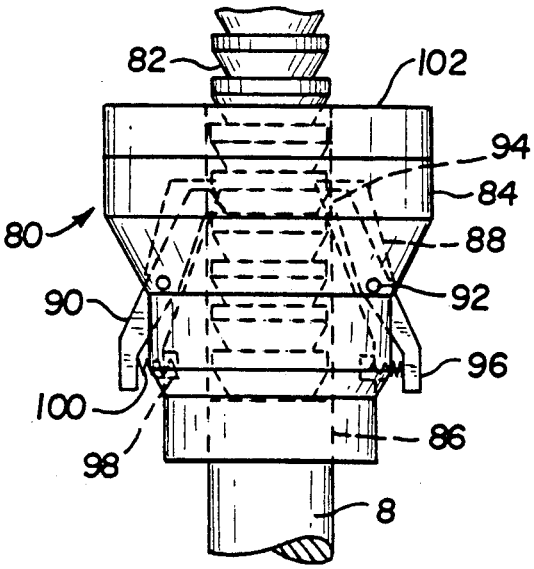
FIG. 19 is a front elevational view of a portion of the elongated bar shown in FIG. 1 including a locking collar in accordance with the present invention.
Figure 20:
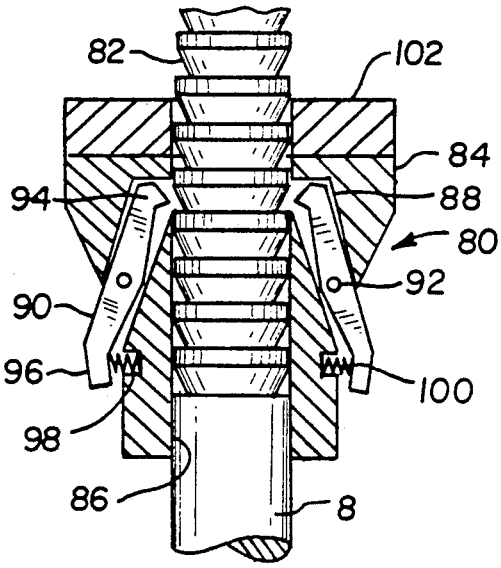
FIG. 20 is a section taken through the locking collar shown in FIG. 19.

A locking collar 80 suitable for holding weights onto the end bars 8, 10 of the exercise apparatus devices discussed above is shown in FIGS. 19 and 20. While a locking collar 80 is shown mounted on a first end bar 8, it is to be understood that a similar locking collar would be mounted on the second end bar 10. The end bar 8 includes a plurality of parallel locking grooves 82 extending abut the outer circumference which engage the locking collar 80 at a desired location.

The locking collar 80 includes a frusto-conical shaped body 84 having an axial, cylindrical bore 86 therethrough. The bore 86 is slightly larger than and adapted to surround the first end bar 8. A pair of spaced channels 88 pass through the body 84 of the locking collar 80 from its outer surface to the bore 86 therein. A locking lever 90 is positioned within each channel 88 and is pivotally mounted therein by a pivot pin 92 extending into the body 84 of the locking collar 80. An inner end of each locking lever 90 terminates in a hook-shaped notch 96 which is adapted to engage a locking groove 82 on the end bar 8. The outer end of each locking lever 90 terminates in a flat thumb pad 96. A blind hole 98 is provided in the body 84 of the locking collar 80 immediately beneath the thumb pad 96 of each locking lever 90. A spring 100 is positioned within each blind hole 98 and extends to and contacts a rear surface of an adjacent thumb pad 96.

The effect of the spring 100 is to bias the thumb pad 96 of the locking lever 90 outwardly, which simultaneously biases the notch 94 of the locking lever 90 inwardly and into the axial bore 86. When the locking collar 80 is positioned on the end bar 8, the locking levers 90 are biased to force the notches 94 into locking engagement with an adjacent locking groove 82. Thus, the locking lever 90 will hold the locking collar 80 at a desired location on the end bar 8. When it is desired to move the locking collar 80, the thumb pad 96 of each locking lever 90 is depressed inwardly, depressing the spring 100 therebeneath. This action pivots the locking lever 90 and raises the notch 94 out of engagement with the locking groove 82, thus permitting the locking collar 80 to be moved to a different position on the end bar 8. When the pressure is released from the thumb pads 96, the notches 94 will move inwardly and once again engage a locking groove 82 and hold the locking collar 80 in place at the new location. A support washer 102 can be provided around the end bar 8 between the locking collar 80 and an adjacent weight.

Having described above the presently preferred embodiments of the present invention, it is to be understood that it may be otherwise embodied within the scope of the appended claims.

I claim:

1. The weight lifting apparatus comprising: an elongated bar having a pair of spaced, open circular housings mounted thereto, each of said circular housings having a support member extending inwardly along at least a portion of an inner circumference of said housing, and a handle assembly positioned within each of said circular housings and rotatably mounted on the support member, with each handle assembly including a pair of rotating handle members positioned on opposite sides of said support member and removeably fastened together in sliding engagement with said support member.

2. The weight lifting apparatus of claim 1 wherein each rotating handle member includes a circular ring and a grip extending across and connected to said ring, with the grips aligned with each other when a pair of rotating handle members are fastened together within a circular housing.

3. The weight lifting apparatus of claim 2 wherein each grip includes a projecting tongue at each end which engages a corresponding groove in said ring.

4. The weight lifting apparatus of claim 2 wherein said support member is a flange which extends substantially along the inner circumference of said circular housing.

5. The weight lifting apparatus of claim 4 wherein said circular ring on each rotating handle member includes an offset extending around its outer circumference, with said offsets together forming a track which surrounds and contacts said flange when a pair of rotating handle members are fastened together within a circular housing.

6. The weight lifting apparatus of claim 5 wherein said flange has a rectangular cross-sectional shape and the offset on each circular ring has a right-angle shape.

7. The weight lifting apparatus of claim 5 wherein an offset on one of said rotating handle members is wider than the offset on the other of said rotating handle members, such that said circular rings overlap each other when fastened together within said circular housing.

8. The weight lifting apparatus of claim 4 wherein said flange includes therein a plurality of recesses, and at least one of said rotating members includes in said offset at least one outwardly biased locking pin which is adapted to engage said recesses and lock said handle assembly in a desired position within a circular housing.

9. The weight lifting apparatus of claim 1 wherein the elongated bar includes a plurality of locking grooves near each end of the bar, and further includes a locking collar carried by each end of the elongated bar, with said locking collars each having at least two pivoting locking levers which are biased inwardly to normally engage said locking grooves and hold said locking collar in a desired location on said bar.

10. The weight lifting apparatus of claim 9 wherein said locking collar has a pair of spaced channels extending therethrough from an exterior surface to an axial bore therein, with a locking lever pivotally mounted in each channel.

11. The weight lifting apparatus of claim 10 wherein each locking lever terminates at an inner end in a notch which is adapted to engage a locking groove, and terminates at an outer end in a flat thumb pad, and with a bias spring extending between the outer surface of the locking collar and a rear surface of said thumb pad, whereby the spring biases the notch end into the axial bore.

12. The weight lifting apparatus comprising: an elongated bar having a pair of spaced, open circular housings mounted thereto, each of said circular housings having a support flange extending inwardly along at least a portion of an inner circumference of said housing, and a handle assembly positioned within each of said circular housings and rotatably mounted on the support flange, with each handle assembly including a pair of rotating handle members positioned on opposite sides of said support flange and removeably fastened together in sliding engagement with said support flange.

13. The weight lifting apparatus of claim 12 wherein each rotating handle member includes a circular ring and a grip extending across and connected to said ring, with the grips aligned with each other when a pair of rotating handle members are fastened together within a circular housing.

14. The weight lifting apparatus of claim 13 wherein each grip includes a projecting tongue at each end which engages a corresponding groove in said ring.

15. The weight lifting apparatus of claim 13 wherein said circular ring on each rotating handle member includes an offset extending around its outer circumference, with said offsets together forming a track which surrounds and contacts said support flange when a pair of rotating handle members are fastened together within a circular housing.

16. The weight lifting apparatus of claim 15 wherein said support flange has a rectangular cross-sectional shape and the offset on each circular ring has a right-angle shape.

17. The weight lifting apparatus of claim 15 wherein an offset on one of said rotating handle members is wider than the offset on the other of said rotating handle members, such that said circular rings overlap each other when fastened together within said circular housing.

18. The weight lifting apparatus of claim 12 wherein said support flange includes therein a plurality of recesses, and at least one of said rotating members includes in said offset at least one outwardly biased locking pin which is adapted to engage said recesses and lock said handle assembly in a desired position within a circular housing.

19. The weight lifting apparatus of claim 12 wherein the elongated bar includes a plurality of locking grooves near each end of the bar, and further includes a locking collar carried by each end of the elongated bar, with said locking collars each having at least two pivoting locking levers which are biased inwardly to normally engage said locking grooves and hold said locking collar in a desired location on said bar.

20. The weight lifting apparatus of claim 19 wherein said locking collar has a pair of spaced channels extending therethrough from an exterior surface to an axial bore therein, with a locking lever pivotally mounted in each channel.

21. The weight lifting apparatus of claim 20 wherein each locking lever terminates at an inner end in a notch which is adapted to engage a locking groove, and terminates at an outer end in a flat thumb pad, and with a bias spring extending between the outer surface of the locking collar and a rear surface of said thumb pad, whereby the spring biases the notch end into the axial bore.

* * * * *